US008418600B2

(12) United States Patent
Heinrich

(10) Patent No.: US 8,418,600 B2
(45) Date of Patent: Apr. 16, 2013

(54) FLUID PUMP DEVICE FOR VEHICLE BRAKING SYSTEMS

(75) Inventor: Volker Heinrich, Nordstemmen (DE)

(73) Assignee: WABCO GmbH, Hannover (DE)

( * ) Notice: Subject to any disclaimer, the term of this patent is extended or adjusted under 35 U.S.C. 154(b) by 741 days.

(21) Appl. No.: 12/653,181

(22) Filed: Dec. 8, 2009

(65) Prior Publication Data

US 2010/0154409 A1 Jun. 24, 2010

(30) Foreign Application Priority Data

Dec. 20, 2008 (DE) ..... 10 2008 064 290

(51) Int. Cl.
*F16J 1/10* (2006.01)
*F04B 53/12* (2006.01)

(52) U.S. Cl.
USPC ..... 92/129; 417/554

(58) Field of Classification Search ..... 92/129; 417/552, 554
See application file for complete search history.

(56) References Cited

U.S. PATENT DOCUMENTS 5,567,135 A * 10/1996 Mueller et al. ..... 417/554

FOREIGN PATENT DOCUMENTS

DE 10 2004 037 146 A1 3/2006

* cited by examiner

*Primary Examiner* — Michael Leslie
(74) *Attorney, Agent, or Firm* — Kramer Levin Naftalis & Frankel LLP

(57) ABSTRACT

A pump device and method minimizes the quantity of air in a vehicle brake system by reducing the volume of detrimental space. The device includes a piston movable between first and second end points, a line system that conducts fluid through the device, and a closing element, movable between an open position releasing the flow of the fluid and a closed position interrupting the fluid flow, that selectively releases the flow of the fluid through the device. The line system includes a through-line formed in the piston for conducting the fluid through the piston. By virtue of a section of the through-line that receives the closing element in the piston, a force is generated that is transmittable from the fluid to the closing element that moves the closing element in the direction of its closed position when the piston is moving in the direction of the first end point.

20 Claims, 3 Drawing Sheets

FLUID PUMP DEVICE FOR VEHICLE BRAKING SYSTEMS

FIELD OF THE INVENTION

The present invention generally relates to an improved fluid pump device and method for minimizing the absolute quantity of air present in a vehicle brake system, e.g., an anti-lock brake system, by reducing the volume of detrimental space.

BACKGROUND OF THE INVENTION

Fluid pump devices of the general type under consideration are known and are used in various technology areas. One important application of such devices is in vehicle brake systems in which the fluid employed is hydraulic fluid for operating the systems.

In some vehicle brake systems, the hydraulic fluid is compressed to a pressure of up to 200 bar. To build up this pressure, the hydraulic fluid to be displaced is first delivered to a pressure space. As a result of piston movement, the incompressible hydraulic fluid is brought to the desired pressure. During subsequent expansion, air dissolved in the hydraulic fluid may be expelled, with the result that the pump device cannot build up any discharge capacity or can build up only a reduced discharge capacity. As a direct consequence, the brake system can no longer be operated or can no longer be operated with the desired degree of safety.

At low temperatures, the presence of air in the hydraulic fluid is critical. At low temperatures, the viscosity of the hydraulic fluid rises, and it therefore subjects the device to greater resistance. Consequently, the discharge capacity of the pump device or the required volume of hydraulic fluid falls. The probability increases that, in the lines of the brake system, areas are formed that consist only of air; and therefore the probability that the brake systems fails or is operated only with reduced power also increases. The problem is exacerbated in that, at low temperatures, the seals of the brake system can shrink and therefore more air can enter.

The quantity of air dissolved in the hydraulic fluid can be minimized by filling the brake system with the hydraulic fluid under a vacuum. However, this is a complicated process and affords advantages only when the brake system is also effectively sealed off so that no air can enter. Furthermore, this process has the added disadvantage that it is not particularly susceptible of being effected outside of a manufacturing facility when the hydraulic fluid needs to be exchanged.

Another way to minimize the absolute quantity of air present in the brake system is to reduce as much as possible the volume of detrimental space. Detrimental space is that portion of the pressure space that remains when the piston of the pump device is at its first end point (i.e., top dead center). With the reduction in detrimental space, the volume of the hydraulic fluid to be displaced also decreases, with the result that the air quantity expelled during expansion is reduced. However, reducing the volume of the detrimental space (or "detrimental volume") presents hurdles, since a certain construction space is required for the accommodation and mounting of, for example, the closing element of the pump device. Thus, for example, while DE 10 2004 037 146 A1 describes a piston pump and attempts to reduce the detrimental volume, the described device still includes multiple components located in the detrimental space (e.g., a restoring spring and a disk-like holding element). The need to use these components places a specific limit on the minimization of the detrimental volume.

SUMMARY OF THE INVENTION

The present invention overcomes disadvantages associated with conventional constructions and provides an improved fluid pump device and method for a vehicle brake system that further reduces the detrimental volume. As described in greater detail hereinafter, the pump device according to embodiments of the present invention includes a piston arranged movably between a first end point and a second end point, a line system for conducting the fluid (e.g., hydraulic fluid) through the device, and a closing element, movable between an open position releasing the flow of the fluid and a closed position interrupting the fluid flow, for selectively releasing the fluid flow through the device. The line system includes a through-line, formed in the piston, for conducting the fluid through the piston. By virtue of a section of the through-line that receives the closing element in the piston, a force is generated that is transmittable from the fluid to the closing element and that moves the closing element in the direction of its closed position when the piston is moving in the direction of the first end point. Because the closing element can be integrated in the piston, the detrimental volume can be further reduced. The piston can be advanced to the corresponding boundary wall of the pressure space, without components having a disturbing effect on one another.

It will be appreciated that the present invention advantageously obviates the need to provide any additional components for actuating or moving the closing element in any way, particularly in the direction of its closed position. The movement of the closing element between its closed position and its open position takes place, according to embodiments of the present invention, solely by virtue of the flow and pressure conditions prevailing in the pump device. Consequently, no construction space is occupied, for example, by restoring springs, and therefore the detrimental space or detrimental volume can advantageously be further reduced (which makes it possible to operate the device reliably at temperatures of down to −40° C.). Vacuum filling is not necessary for this purpose, but may nevertheless be carried out to further reduce the fraction of air contained in the brake system. Since no components act on the closing element, it is possible to mount the inventive device such that the closing element moves out of its closed position when the device is not being operated. For this purpose, the device is mounted such that the longitudinal axis of the piston runs parallel to the direction of action of gravity. Due to gravity, the closing element is moved out of its closed position. The advantage of this is that in vacuum filling, in which first the air is removed from the line system of the device and then the line system is filled, the pressure space is also evacuated.

A method utilizing the inventive device for conveying and compressing fluid in accordance with an exemplary embodiment of the present invention includes the steps of: (i) conveying the fluid with the aid of the piston arranged movably between the first end point and the second end point, (ii) conducting the fluid through the device by means of the line system, (iii) selectively releasing the fluid flow through the device with the aid of the closing element movable between open position releasing the fluid flow and closed position interrupting the fluid flow, and (iv) generating a force, transmittable from the fluid to the closing element, for moving the closing element in the direction of the closed position when the piston is moving in the direction of the first end point.

A further aspect of the present invention relates to a vehicle brake system that includes (i) a fluid reservoir, (ii) the device according to embodiments of the present invention, (iii) an accumulator for storing conveyed and/or compressed fluid, and (iv) a brake installation.

Still other objects and advantages of the present invention will in part be obvious and will in part be apparent from the specification.

The present invention accordingly comprises the features of construction, combination of elements, and arrangement of parts that will be exemplified in the constructions hereinafter set forth, as well as the various steps and the relation of one or more of such steps with respect to each of the others, and the scope of the invention will be indicated in the claims.

BRIEF DESCRIPTION OF THE DRAWINGS

For a fuller understanding of the present invention, reference is had to the following description taken in connection with the accompanying drawings in which.

DETAILED DESCRIPTION OF THE PREFERRED EMBODIMENTS

Figure 1:
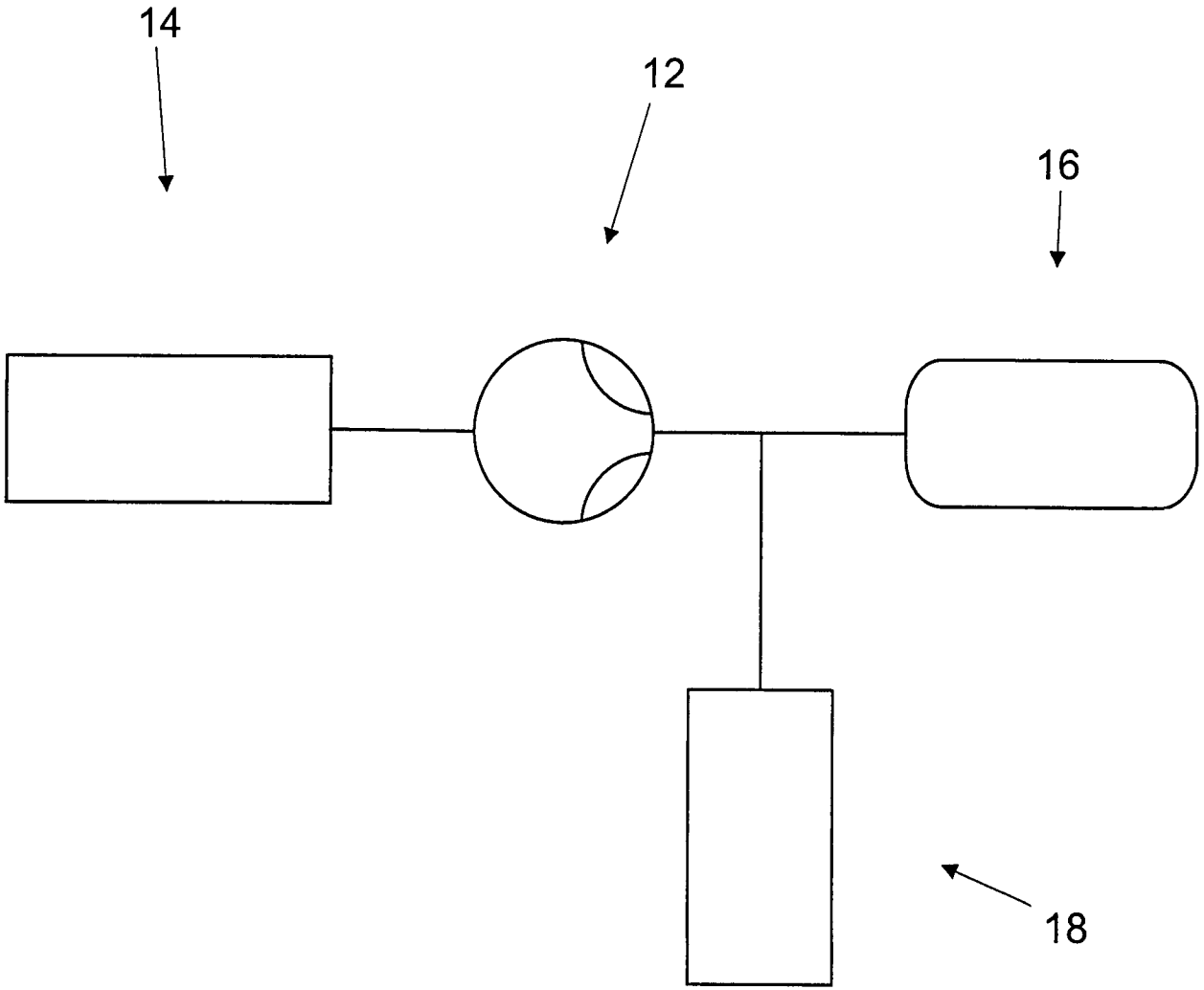
FIG. 1 is a block diagram of a vehicle brake system including a device according to the present invention.

As stated above, the present invention provides an improved fluid pump device construction and arrangement that minimizes the absolute quantity of air present in a vehicle brake system by reducing the volume of detrimental space. The pump device according to embodiments of the present invention includes a piston arranged movably between a first end point and a second end point, a line system that conducts fluid through the device, and a closing element, movable between an open position releasing the flow of the fluid and a closed position interrupting the fluid flow, that selectively releases the fluid flow through the device. The line system includes a through-line, formed in the piston, for conducting the fluid through the piston. A section of the through-line that receives the closing element in the piston effects generation of a force that is transmittable from the fluid to the closing element and that moves the closing element in the direction of its closed position when the piston is moving in the direction of the first end point. Because the closing element can be integrated in the piston, the detrimental volume can be further reduced. The piston can be advanced virtually completely as far as the corresponding boundary wall of the pressure space, without components having a disturbing effect on one another.

The section of the through-line that receives the closing element in the piston has a diameter (second diameter) that is larger than that of the through-line proper (first diameter). Due to this difference in diameters, the flow of fluid into the pressure space can be released or prevented in a simple manner. For this purpose, the closing element has a diameter that corresponds essentially to the second diameter, so that the closing element can simply be inserted into the section and be guided laterally by this. When the closing element is located where the diameters vary, the closing element closes off the through-line, with the result that the flow of the fluid into the pressure space is interrupted. This reliable closing construction can be manufactured in a simple manner.

An embodiment of the invention includes a bore issuing into the section of the through-line having the greater (second) diameter. With the aid of this bore, fluid flow is deflected such that it is accelerated when the fluid exhibits a tendency to flow out of the pressure space back into the delivery duct. Situations of this kind arise when the piston changes its direction of movement at the second end point or bottom dead center and moves in the direction of the first end point or top dead center. The accelerated flow acts on the closing body such that it is carried along by the fluid and closes the through-line. The bore can be manufactured in a very simple manner, and, therefore, this embodiment is both cost-effective and operationally reliable.

In an embodiment of the invention, a restoring element returns the piston in the direction of the second end point, and the piston includes a recess for receiving the restoring element. The use of the restoring element ensures that the piston is moved reliably in the direction of the second end point so long as no force greater than the restoring force of the restoring element acts in the opposite direction. The configuration of the drive of the piston can thus be simplified. A simple eccentric can be used, and therefore the use of a mechanically more complicated connecting rod can be dispensed with. This simplifies the construction; it also allows the device to be designed to be more compact. Arranging the restoring element in the recess likewise contributes to minimizing the detrimental space. In this case, the recess is preferably configured such that it surrounds the restoring element virtually completely when the element is compressed to its block length at the top dead center of the piston. The block length designates the length of a spring when it is compressed to the maximum extent. As a result, the detrimental volume is further reduced.

The restoring element can be a spring of rectangular cross section. Using springs of rectangular cross section, the same block lengths can be implemented as with springs having a round cross section. The greater volume of a spring of rectangular cross section additionally reduces the detrimental volume.

In accordance with embodiments of the inventive device, the bore runs between the recess and the section of the through-line that receives the closing element in the piston. The fluid is thereby routed such that the force exerted on the closing element is intensified during the corresponding movement of the piston in the direction of its top dead center, such that the closing element is moved reliably and effectively in the direction of its closed position. This arrangement of the bore can be manufactured in a simple manner, requiring no special tools or manufacturing steps, and therefore cost-effectively.

In an embodiment of the inventive device, the bore runs essentially perpendicularly with respect to a longitudinal axis of the piston. This can be manufactured in a simple manner, as compared to bores that do not run perpendicularly with respect to the longitudinal axis of the piston. Alternatively, the bore can have an oblique run in relation to the longitudinal axis of the piston.

Preferably, the inventive device has at least one stop element for fixing the open position or closed position of the closing element in the section of the through-line that receives the closing element in the piston or in the through-line. By at least one of these positions being fixed, the situation is prevented where the closing element is moved in an uncontrolled manner in the through-line or even in the pressure space. In particular, the closing element is prevented from falling out of the through-line or out of the section of the through-line that receives the closing element in the piston. In this case, the stop element can be configured such that only mechanical contact between the stop element and the closing element is made when the closing element reaches the open or closed position. It is likewise possible that the stop element and the closing element sealingly contact one another. In the latter case, the section of the through-line that receives the closing element in the piston can be dispensed with, so that the piston, overall, can be manufactured in a simpler manner.

The closing element can have an essentially spherical design. Spherical closing elements are common and can therefore be obtained simply and cost-effectively. Furthermore, they have the advantage that their orientation does not have to be checked because they act identically in any orientation.

The closing element can also have an essentially cylindrical design. The cylindrical configuration of the closing element makes it possible to minimize its extent in the direction of the longitudinal axis of the piston, with the result that the detrimental space can be further reduced, as compared with a spherical configuration of the closing element.

In accordance with another embodiment of the present invention, the pressure space for compressing the fluid includes a further closing element for selectively releasing the flow of the fluid out of the pressure space. In this embodiment, the device is particularly suitable for displacing the fluid. The further closing element can be movable between a first end position releasing the flow of the fluid and a second end position interrupting the flow by a further restoring element (e.g., a spring) for returning the further closing element into the second end position. The further restoring element permits release of the flow of the fluid out of the pressure space only when the piston is also moving in the direction of the first end point. This ensures that when the piston is moving in the direction of the second end point, no fluid is sucked out of that part of the brake system that lies downstream of the device back into the pressure space.

Another embodiment of the present invention includes an insertion element for separating the pressure space from the outlet line. The insertion element makes it possible in a simple way to adapt the shape of the pressure space to the existing requirements. Thus, for example, a recess for mounting and guiding the restoring element can be provided without having to undertake a complicated and expensive re-machining of the device space itself.

Advantageously, the insertion element can have an orifice cooperating with the further closing element to permit the passage of fluid. In this embodiment, the insertion element can be incorporated into the closing mechanism of the pressure space. As a result, the need to use further components is obviated and complicated configurations of the housing of the device also are unnecessary. Consequently, the device can be manufactured more simply and therefore more cost-effectively.

Referring now to the drawing figures, FIG. 1 is a block diagram depicting a vehicle brake system 10 including a device 12 according to the present invention. Device 12 is connected to a fluid reservoir 14, in which fluid is stored. In the exemplary embodiments described herein, the fluid is hydraulic fluid. However, it should be understood that the present invention is not limited to hydraulic fluid applications, and that the mode of operation of device 12, as described in terms of hydraulic fluid, applies to fluids in general.

Device 12 is constructed and arranged to suck in hydraulic fluid from reservoir 14 and convey or compress it. Compressed hydraulic fluid can be delivered, as required, either to an accumulator 16 or directly to a brake installation 18. While brake installation 18 is not shown in detail in the drawing figures, it should be understood that it includes all the devices, such as for example lines, brakes and valves, that are necessary for braking a vehicle.

Figure 2:
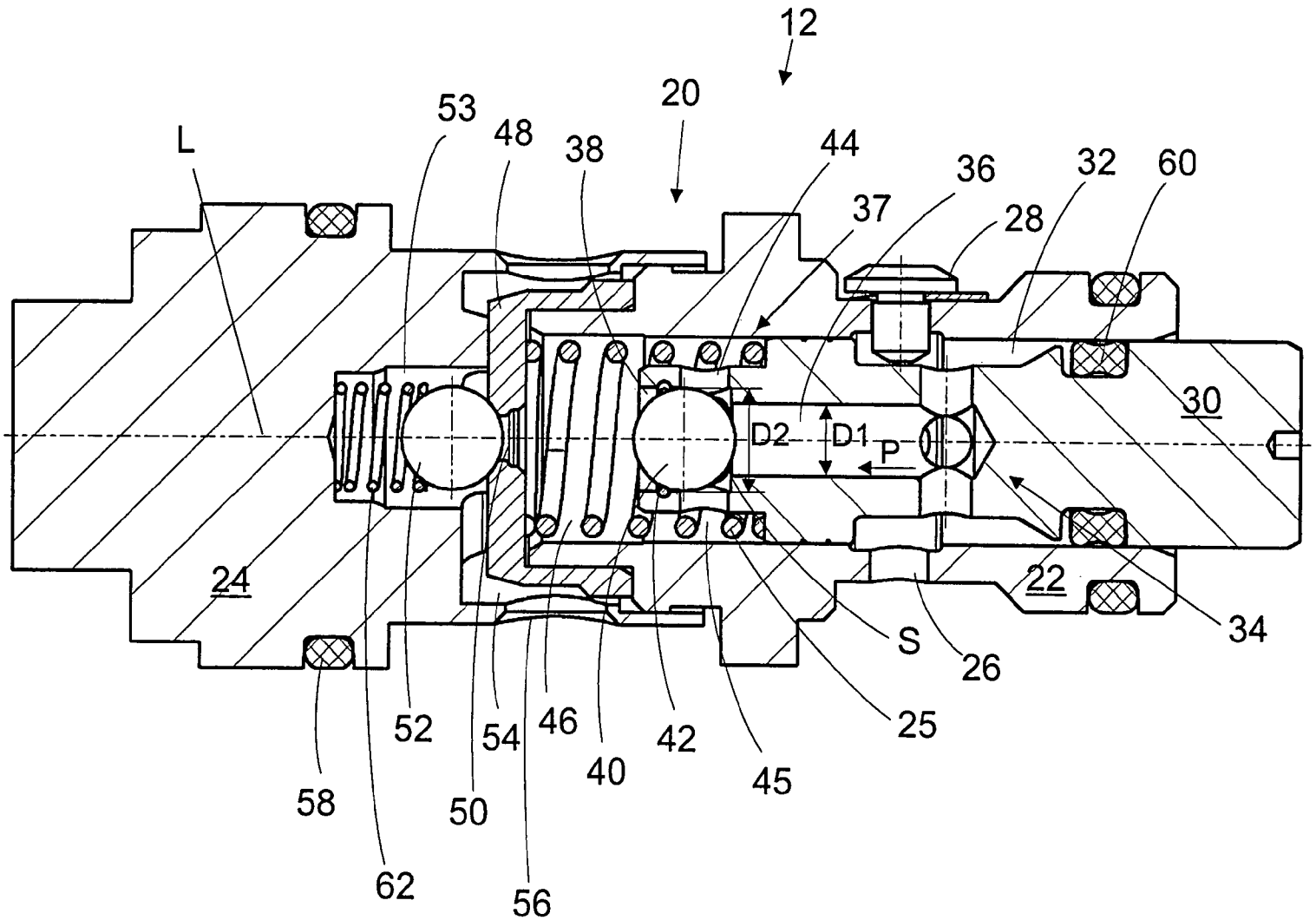
FIG. 2 depicts a first exemplary embodiment of the device according to the present invention with a spherical first closing body.

Device 12, as depicted in FIG. 2 illustrating the conveyance and/or compression of fluid, in particular of hydraulic fluid, has a housing 20 in which a piston 30 is arranged movably along its longitudinal axis L between a first and a second end point. A restoring element 25 is provided for returning piston 30 to its second end point. Housing 20 consists of a first part 22 and a second part 24 that are connected to one another in a suitable manner. With housing 20 being divided into two parts, the mounting of the device is simplified. In housing 20, a connection 26 is provided by means of which device 12 is connected to fluid reservoir 14 and through which hydraulic fluid can be delivered to device 12. Connection 26 issues into a taper 32 of piston 30, which has an elongate configuration, so that fluid communication with the connection is ensured independently of the position of the piston. Device 12 includes a force generator 37.

A line system 34 is provided for conducting hydraulic fluid through device 12. Line system 34 comprises a through-line 36 located in piston 30 and in fluid communication with a taper 32. Force generator 37 includes a section 38 in through-line 36. Through-line 36 can be in the form of a bore that runs radially or axially with respect to the longitudinal axis L of piston 30. The through-line running along longitudinal axis L of piston 30 has a diameter D1 and merges into section 38 that has a diameter D2, that is greater than D1.

A closing element 40, which is shown having a spherical configuration in FIG. 2, is arranged in section 38. Furthermore, a stop element 42 is provided in section 38 and prevents closing element 40 from falling out of section 38 in the direction of fluid conveyance, which is indicated by the arrow P. When closing element 40 abuts stop element 42, it is in open position. In the example illustrated, closing element 40 can be moved in the longitudinal direction of piston 30 between stop element 42 and a location S at which the through-line merges into section 38 and the diameter changes from 01 to 02. When element 40 is in location S, it is in closed position. Furthermore, section 38 has at least one bore 44 that runs essentially radially with respect to the longitudinal axis L of piston 30. The bore extends from section 38 in the direction of a recess 45 of piston 30. Other runs and orientations of the bore can be employed. Recess 45 receives restoring element 25.

Piston 30 is followed in the direction of fluid conveyance by a pressure space 46, out of which hydraulic fluid is displaced during a corresponding movement of the piston. Pressure space 46 is closed off downstream by an insertion element 48. Insertion element 48 has an essentially cylindrical shape and is fixed by first and second parts 22, 24 of housing 20. Insertion element 48 has an orifice 50 through which hydraulic fluid can leave pressure space 46. Orifice 50 is closed by means of a further closing element 52, which is pre-stressed by a further restoring element 62. Further restoring element 62 is mounted in a depression 53 of second part 24 of housing 20. Likewise arranged in second part 24 of housing 20 is an outlet line 54 through which hydraulic fluid can leave device 12. Outlet line 54 issues into at least one outlet connection 56, to which lines (not illustrated), for example of brake system 10, can be connected. In the example illustrated, housing 20 itself comprises two seals 58 by means of which device 12 can be sealed off with respect to adjacent components and, in particular, with respect to air.

Piston 30 is sealed off via piston seals 60, which are designed in keeping with the movements of the piston.

The conveyance and compression of hydraulic fluid takes place as follows: In the example depicted in FIG. 2, piston 30 moves in the direction of its second end point, also designated as bottom dead center (BDC). That is, piston 30 moves away from insertion element 48. Piston 30 is moved by a drive (not shown), for example an eccentric, along its longitudinal axis L. Closing element 40 is in its open position and releases the flow of hydraulic fluid through through-line 36. When piston 30 reaches its BDC, it changes its direction of movement and then moves in the direction of insertion element 48. Hydraulic fluid located in pressure space 46 is displaced. Closing element 40 then closes through-line 36, and further closing element 52 closes orifice 50 of insertion element 48, so that the fluid to be compressed cannot emerge from pressure space 46. Closing element 40 is in closed position at location S at which through-line 36 merges into section 38 or where the diameter changes from D1 to D2. Displacement proceeds until piston 30 has reached its first end point or its top dead center (TDC), the pressure of the fluid in pressure space 46 exerting upon further closing element 52 a force that is higher than the pre-stressing force of further restoring element 62 so that orifice 50 is released. Hydraulic fluid can then enter the outlet line 54 and leave the device 12 via a corresponding outlet connection 56.

After reaching its first end point or its TDC, piston 30 changes its direction of movement, so that a vacuum is generated in pressure space 46 and hydraulic fluid is sucked in. Closing element 40 then moves into open position and abuts stop element 42, so that pressure space 46 and through-line 36 are in fluid communication with one another. At the same time, further closing element 52 is closed. This operation continues until piston 30 has reached its BDC or the second end point. Piston 30 subsequently changes its direction of movement, and the fluid located in pressure space 46 is displaced. This, however, presupposes that closing element 40 interrupts fluid communication between pressure space 46 and through-line 36—that is, resumes closed position. At the time piston 30 changes its direction of movement and moves in the direction of its TDC, the fluid located in pressure space 46 tends to flow back into through-line 36. By virtue of the inventive configuration of the recess 45, bore 44 and closing element 40, flow occurs at the transition between bore 44 and through-line 36 and closing element 40 that pulls along or carries along closing element 40 and thus brings the latter into closed position. The transfer of closing element 40 from open position to closed position is assisted by the mass inertia of the closing element, which, when the direction of movement of piston 30 is changed, causes a relative movement of the closing element in the direction of its closed position. When closing element 40 is in closed position, it is held there on account of the pressure building up in pressure space 46.

Figure 3:
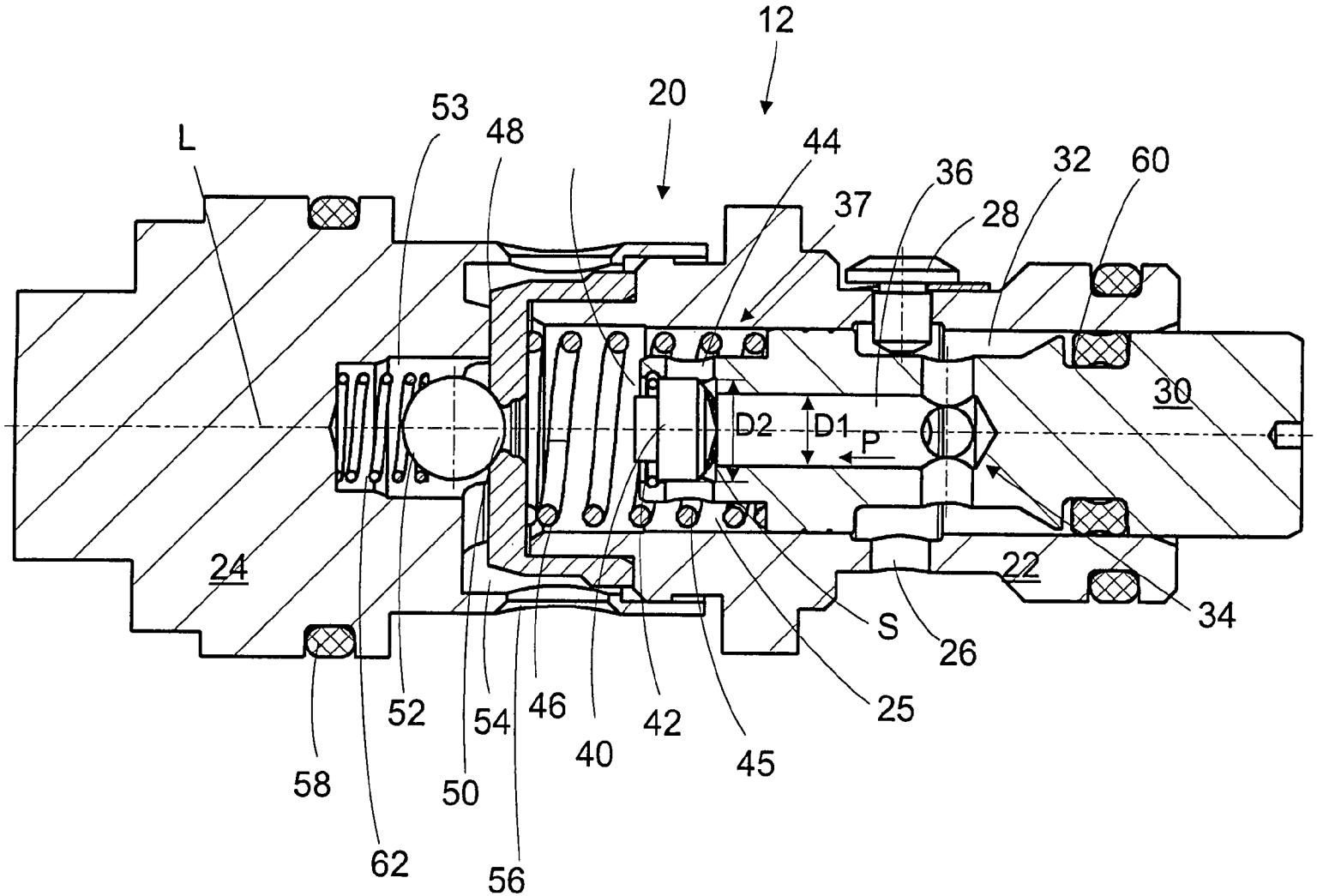
FIG. 3 depicts a second exemplary embodiment of the device according to the present invention with an essentially cylindrical first closing body.

FIG. 3 illustrates a further exemplary embodiment of device 12 according to the present invention. In this embodiment, closing element 40 is not configured spherically. Rather, it is essentially cylindrical to reduce its extent along longitudinal axis L of piston 30 and thus make a further contribution to reducing detrimental volume. It should be appreciated that both the function and remaining set-up of the embodiment depicted in FIG. 3 correspond to that of the embodiment depicted in FIG. 2.

A method utilizing the inventive device for conveying and compressing fluid in accordance with an exemplary embodiment of the present invention includes the steps of: (i) conveying the fluid with the aid of the piston arranged movably between the first end point and the second end point, (ii) conducting the fluid through the device by means of the line system, (iii) selectively releasing the fluid flow through the device with the aid of the closing element movable between open position releasing the fluid flow and closed position interrupting the fluid flow, and (iv) generating a force, transmittable from the fluid to the closing element, for moving the closing element in the direction of the closed position when the piston is moving in the direction of the first end point. While the foregoing method steps are preferably effected in the order specified, it should be understood that the present invention is not restricted to such specified order. Also, it should be appreciated that the advantages achieved by the method according to the present invention correspond to those presented with regard to the inventive device.

It will thus be seen that the objects set forth above, among those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A device for conveying a fluid, comprising:

a piston arranged movably between a first end point and a second end point;

a line system for conducting said fluid through said device;

a closing element to selectively release flow of said fluid through said device, said closing element being movable between an open position releasing flow of said fluid and a closed position interrupting flow of said fluid; and a force generator to generate a force transmittable from said fluid to said closing element to move said closing element in the direction of said closed position when said piston is moving in the direction of said first end point, wherein said closing element moves in the direction of said closed position only in response to said force.

2. The device according to claim 1, wherein said fluid is hydraulic fluid.

3. The device according to claim 1, wherein said line system includes a through-line formed in said piston, said through-line being configured to conduct said fluid through said piston, and wherein said force generator includes a section in said through-line for receiving said closing element in said piston.

4. The device according to claim 3, wherein said through-line has a first diameter, and wherein said section has a second diameter, said second diameter being larger than said first diameter.

5. The device according to claim 3, further comprising a restoring element to return said piston in the direction of said second end point, and wherein a recess is defined in said piston to receive said restoring element.

6. The device according to claim 5, wherein said restoring element is a spring having a rectangular cross section.

7. The device according to claim 3, further comprising at least one stop element to fix at least one of said open position and said closed position of said closing element in at least one of said section and said through-line.

8. The device according to claim 1, wherein said closing element is substantially spherical.

9. The device according to claim 1, wherein said closing element is substantially cylindrical.

10. The device according to claim 1, further comprising a pressure space, and a further closing element to selectively release flow of said fluid out of said pressure space.

11. The device according to claim 10, wherein said further closing element is movable between a first end position releasing flow of said fluid and a second end position interrupting flow of said fluid, and further comprising a further restoring element to return said further closing element into said second end position.

12. The device according to claim 10, further comprising an outlet line for discharging said fluid out of said device, and an insertion element to separate said pressure space from said outlet line.

13. The device according to claim 12, wherein said insertion element has an orifice cooperating with said further closing element to permit the passage of said fluid.

14. A vehicle brake system, comprising a fluid reservoir for storing a fluid;

a device as claimed in claim 1;

an accumulator for storing at least one of conveyed and compressed states of said fluid; and a brake installation constructed and arranged to decelerate a vehicle.

15. The vehicle brake system according to claim 14, wherein said fluid is hydraulic fluid.

16. A device for conveying a fluid, comprising:

a piston arranged movably between a first end point and a second end point;

a line system for conducting said fluid through said device;

a closing element to selectively release flow of said fluid through said device, said closing element being movable between an open position releasing flow of said fluid and a closed position interrupting flow of said fluid; and a force generator to generate a force transmittable from said fluid to said closing element to move said closing element in the direction of said closed position when said piston is moving in the direction of said first end point, wherein said line system includes a through-line formed in said piston, said through-line being configured to conduct said fluid through said piston, and wherein said force generator includes a section in said through-line for receiving said closing element in said piston, and wherein said force generator further includes a bore extending into said section.

17. A device for conveying a fluid, comprising:

a piston arranged movably between a first end point and a second end point;

a line system for conducting said fluid through said device;

a closing element to selectively release flow of said fluid through said device, said closing element being movable between an open position releasing flow of said fluid and a closed position interrupting flow of said fluid;

a force generator to generate a force transmittable from said fluid to said closing element to move said closing element in the direction of said closed position when said piston is moving in the direction of said first end point, wherein said line system includes a through-line formed in said piston, said through-line being configured to conduct said fluid through said piston, and wherein said force generator includes a section in said through-line for receiving said closing element in said piston; and a restoring element to return said piston in the direction of said second end point, and wherein a recess is defined in said piston to receive said restoring element, and wherein said force generator further includes a bore extending between said recess and said section.

18. The device according to claim 17, wherein said bore extends substantially perpendicularly with respect to a longitudinal axis of said piston.

19. A method for conveying fluid, comprising:

moving said fluid using a piston in a device for conveying said fluid, wherein said piston is arranged movable between a first end point and a second end point;

conducting said fluid through said device using a line system;

selectively releasing flow of said fluid through said device using a closing element, said closing element being movable between an open position releasing flow of said fluid and a closed position interrupting flow of said fluid; and generating a force transmittable from said fluid to said closing element to move said closing element in the direction of said closed position when said piston is moving in the direction of said first end point, wherein said closing element moves in the direction of said closed position only in response to said force.

20. The method according to claim 19, wherein said fluid is hydraulic fluid.

* * * * *